United States Patent [19]

Szabo

[11] Patent Number: 4,982,470

[45] Date of Patent: Jan. 8, 1991

[54] APPARATUS FOR APPLYING OF AN ADHESIVE FOR FLOOR COVERINGS

[75] Inventor: Stephan L. Szabo, Küsnacht, Switzerland

[73] Assignee: S. Szabo AG, Zurich, Switzerland

[21] Appl. No.: 412,488

[22] Filed: Sep. 26, 1989

[51] Int. Cl.[5] ..... B05D 1/42; E01C 19/12

[52] U.S. Cl. ..... 15/104 S; 15/144 R; 15/235.6; 15/235.8

[58] Field of Search ..... 15/104 S, 235.4, 235.8, 15/144 R, 235.6; 404/97

[56] References Cited

U.S. PATENT DOCUMENTS 3,611,470 10/1971 Gaston ..... 15/104 S 3,803,662 4/1974 Glejf ..... 15/104 S

*Primary Examiner*—Edward L. Roberts

*Attorney, Agent, or Firm*—A. W. Breiner

[57] ABSTRACT

The apparatus includes a stick allowing a handling in a standing position and which is to be held obliquely directed to the floor, and a bearing body is mounted to the lower end of the stick in which a first pivot axis is supported which at its lower end is rigidly mounted to a joint body in which a second pivot axis is supported by means of which a supporting body consisting of a disk is located relative to the joint body. An applying spatula is exchangeably mounted to the supporting body. An operating rod is pivotably mounted to the end of the joint body which at its other end is pivotably mounted to a lever which is pivotable by means of a mounting member located roughly halfway along the longitudinal extent of the stick. By means of such also the joint body and accordingly the applying spatula mounted thereto via the supporting body is pivotted about an angle of less than 180° before after a movement of the stick along the floor in the one direction the opposite movement for the spreading of the adhesive agent is initiated. At each change of direction the applying spatula can be adjusted again parallel to the floor around the second pivot axis. By means of this apparatus the adhesive for floor coverings can be applied in a standing position.

6 Claims, 1 Drawing Sheet

APPARATUS FOR APPLYING OF AN ADHESIVE FOR FLOOR COVERINGS

BACKGROUND OF THE INVENTION

1. FIELD OF THE INVENTION

The present invention relates to an apparatus for applying an adhesive for floor coverings and including an applying spatula having a toothed edge.

When installing floor coverings such as wall-to-wall carpets which are glued to a floor a first step is the placing of an adhesive agent onto the floor which is spread by aid of a spatula having a toothed edge such as to produce a uniformly thin layer of such adhesive agent.

2. DESCRIPTION OF THE PRIOR ART

In order to apply and to spread such adhesive agent the worker works kneeling when he manually spreads the adhesive agent with the spatula. The permanent working on the knees in this profession leads often to severe health problems such that quite often a person of such profession must quit this profession. Furthermore, an additional health hazard encountered in this profession is the continuous breathing of the vapors of the solvent for such adhesive agents. Especially when the worker is in a kneeling position he is at a small distance only from the location where such vapors emanate.

SUMMARY OF THE INVENTION

It is, therefore, a general object of the present invention to provide an apparatus for applying an adhesive for floor coverings which allows to avoid health hazards and injuries to health specifically due to a working in a kneeling position.

A further object is to provide an apparatus allowing such work in an upright standing position such that the head of a worker is not exposed to the area of the emanating vapors.

Yet a further object of the invention is to provide an apparatus which includes a double joint and a stick which is suitable to be manipulated by a person in a standing position and is to be held obliquely relative to a respective floor and having an applying spatula which is mounted to the lower end of the stick such to be pivotable simultaneously around two axes, which double joint includes a bearing body mounted to the end of the stick and a first pivot axis supported therein and extending at an angle relative to the stick, and includes a joint body mounted to the first pivot axis and a second pivot axis supported in the joint body and a supporting body mounted to the second pivot axis at which supporting body the applying spatula is mounted to, and includes further an operating rod pivotably mounted to one end of the joint body at one of its ends at a distance from the first pivot axis, which operating rod extends parallel to the stick and is pivotably mounted at its other end to a lever extending at least approximately parallel to the joint body which lever is rigidly mounted to an operating axis extending at least approximately parallel to the first pivot axis and includes a handle, which operating axis is supported in a supporting body located approximately halfway along the longitudinal extent of the stick such to have the applying spatula pivoting around the first pivot axis by means of the manually rotatable operating axis at each point of return of the stick moved manually back and forth over a floor, whereby the applying spatula attains the respective position of its toothed edge parallel to the floor by a pressing thereagainst by a pivoting around the second pivot axis.

Accordingly, an apparatus for applying an adhesive in a standing position is provided having a stick which directed obliquely against the floor is moved manually by both hands similar to a scythe but of which the applying spatula is pivoted at the end of a moving motion by almost 180° such to push and spread the adhesive always at its same side and the same angle of attack of the spatula.

BRIEF DESCRIPTION OF THE DRAWING

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
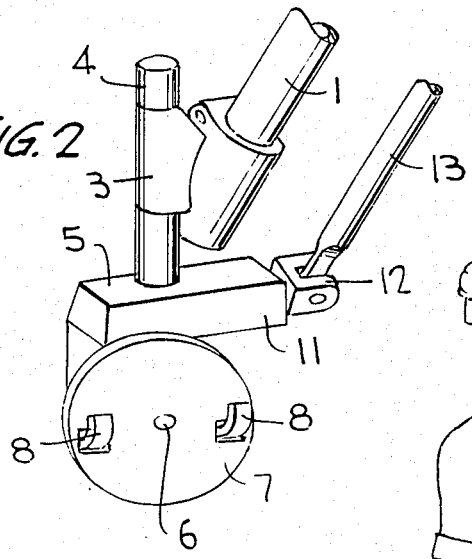
FIG. 2 is a view of the lower end of the apparatus without the applying spatula, from the reverse and at an increased scale.

The apparatus includes a stick 1 having a handle 2 mounted to its upper end. A bearing body 3 for a first pivot axis 4 supported therein is mounted to the lower end of the stick 1. This pivot axis 4 extends adjacent the stick 1 and at an angle relative thereto. A joint body 5 is mounted to the lower end of the pivot axis 4. This joint body 5 forms a support for a second pivot axis 6 which intersects the first pivot axis 4 at an angle different from 90°. A supporting body 7 having the shape of a circular disk is mounted to the pivot axis 6. The angle above the pivot axis 6 which is defined by this pivot axis 6 and the first pivot axis 4 is an obtuse angle which means that the supporting body 7 having the shape of a circular disk which extends obliquely and towards the rear in FIG. 2 abuts by its planar back side the correspondingly bevelled joint body 5 and can be rotated relative to this joint body 5. The supporting body 7 carries two hook-like shaped mounting members 8 such to hold exchangeably the applying spatula 10 having two corresponding openings 9 on the support body 7 whereby the hook-shaped mounting members 8 snap in through the openings 9. The bearing body 3 including the first pivot axis 4 and the joint body 5 mounted thereto and including the supporting body 7 pivotable around the second pivot axis 6 relative to this joint body form a double joint which allows that the applying spatula can simultaneously pivot around two axes relative to the stick 1.

Figure 1:
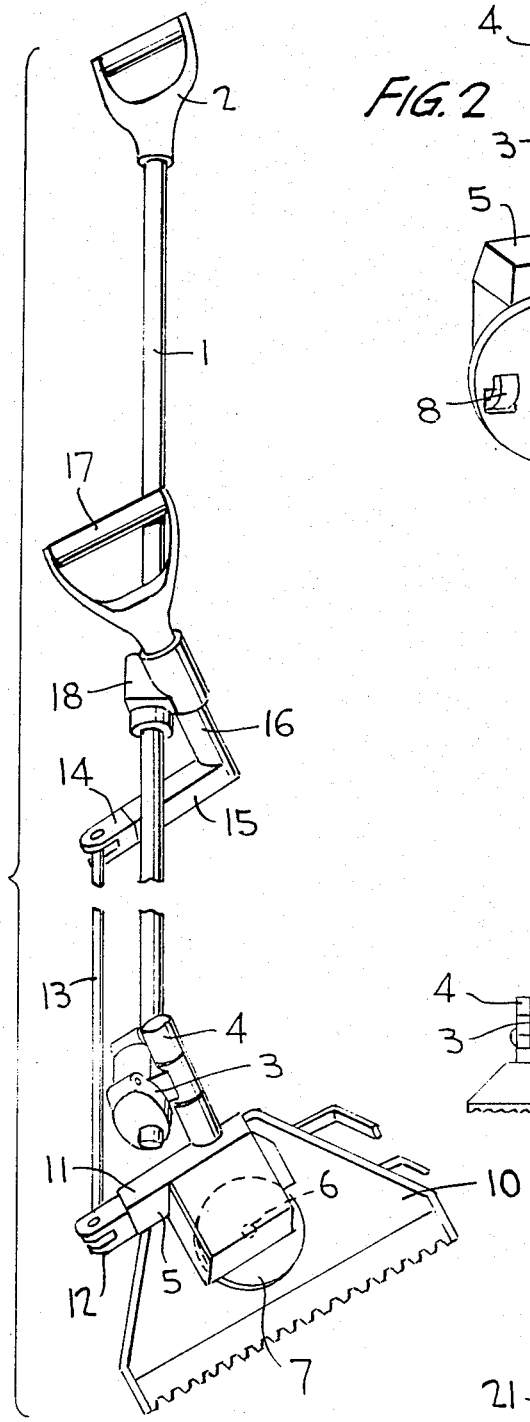
FIG. 1 is a schematic front view of the apparatus.
Figure 3:
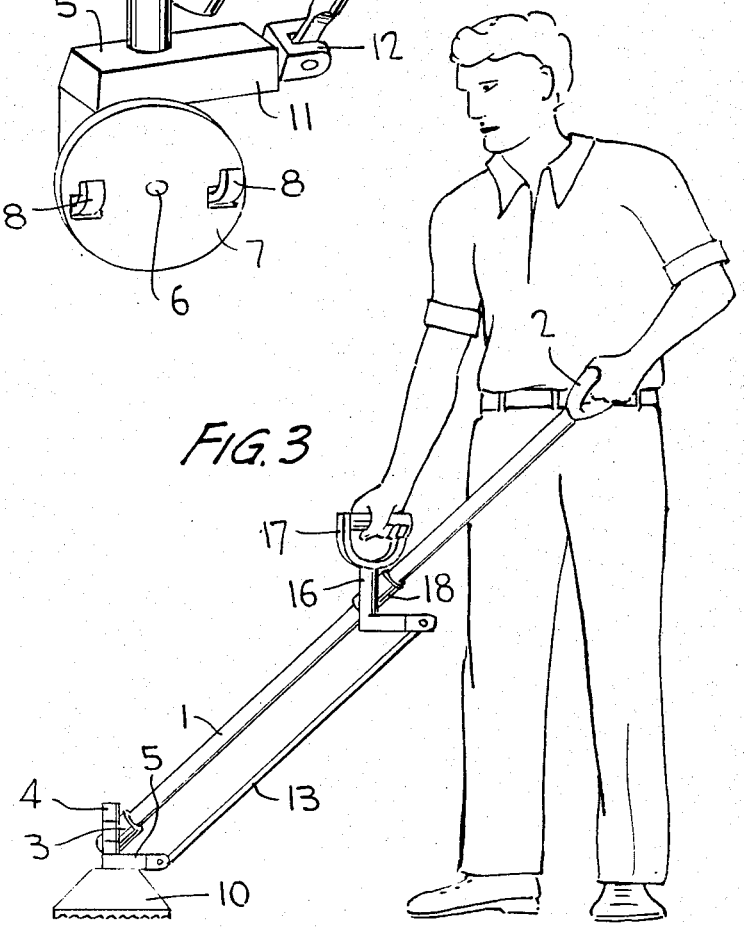
FIG. 3 illustrates the apparatus in its operating position when used by a worker.

The joint body 5 includes an end 11 projecting at the one side thereof as a square shaped member and an intermediate member 12 is rotatably mounted to mentioned end 11 but must be rotatable only within a small angle of rotation. An operating rod 13 is pivotably mounted to this intermediate member 12 which rod 13 extends approximately parallel to the stick 1. The other end of this operating rod 13 is in turn mounted via an intermediate member 14 to the end of a lever. 15:-which extends approximately parallel to the joint body 5 in a direction towards the at one side projecting extension 11 of this joint body such as illustrated in FIG. 1. The lever 15 is rigidly arranged at the lower end of an operating axis 16 which latter is rigidly mounted at its upper end to a handle 17. The operating axis 16 is mounted via a supporting body 18 to the stick and such that this operating rod 16 extends at least approximately parallel to the first pivot axis 4. The supporting body 18 is mounted to the stick 1 about half-way of its longitudinal extent but somewhat closer to the end of the stick 1 having the handle 2 such that the apparatus can be operated by both hands such as illustrated in FIG. 3. The stick 1 and the operating rod 13 extending aPProximately parallel thereto the joInt body 5 which is mounted to the first pivot axis 4 and the lever 15 which is mounted to the operating axis 16 form together a joint parallelogram such that upon every rotative movement of the operating axis 16 about a given pivot angle the applying spatula 10 will pivot about roughly the same angle. During such movement the operating rod 13 does not remain in an imaginary plane extending through the stick but rather moves in the space forward and rearward, resp. which is possible only due to the rotatably mounted intermediate members 12 and 14 which rotate thereby respectively relative to the joint body 5 and relative to the lever 15, respectively.

The apparatus allows to spread the adhesive agent for a floor covering over a floor at a standing position. At the end of a curvilinear pivoting movement of the applying spatula 10 sweeping over the floor the applying spatula is pivoted by aid of the handle 17 through an angle between 140° and 160° such that the adhesive agent can be spread further during the subsequent pivoting movement by the same side of the applying spatula. After every pivoting movement the lower, toothed edge 20 of the applying spatula 10 would extend at an angle relative to the plane of the floor and because of this the applying spatula 10 is at the same time pivotable around the second pivot axis 6 such that by a simple pressing against the floor the applying spatula 10 adjusts itself such that the toothed lower edge 20 extends parallel to the plane of the floor.

Figure 4:
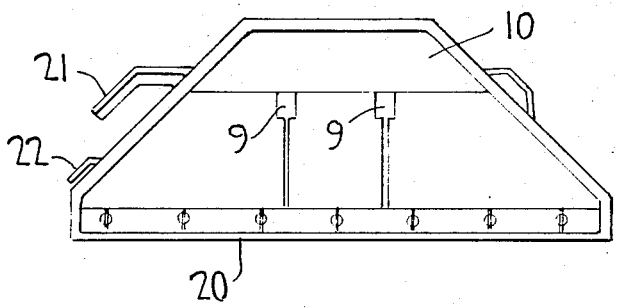
FIG. 4 illustrates a front view of the applying spatula.

The applying spatula 10 illustrated in FIG. 4 may be mounted to a handle by means of the two recesses 9 such to use it as has been conventional. The applying spatula 10 includes, furthermore, a hook-shaped projection 21 at its edge by means of which if the spatula can be hung on a can for the adhesive agent. Furthermore, a stripper 22 for used toothed webs is located at the same side of the spatula 10. The toothed lower edge consists preferably of an exchangeable toothed web 20.

While there is shown and described a present preferred embodiment of the invention, it is to be distinctly understood that the invention is not limited thereto, but may be otherwise variously embodied and practiced within the scope of the following claims.

I claim:

1. An apparatus for applying of an adhesive for floor coverings and including an applying spatula having a toothed edge, comprising a double joint and a stick which is suitable to be manipulated by a person in a standing posItIon and Is to be held obliquely relative to a respective floor and which applying spatula is mounted to the lower end of said stick such to be pivotable simultaneously around two axes, which double joint includes a bearing body mounted to the end of the stick and a first pivot axis supported therein and extending at an angle relative to said stick, and includes a joint body mounted to the first pivot axis and a second pivot axis supported in said joint body and a supporting body mounted to said second pivot axis at which supporting body said applying spatula is mounted to, comprising further an operating rod pivotably mounted to one end of said joint body at one of its ends at a distance from said first pivot axis, which operating rod extends parallel to said stick and is pivotably mounted at its other end to a lever extending at least approximately parallel to said joint body which lever is rigidly mounted to an operating axis extending at least approximately parallel to said first pivot axis and includes a handle, which operating axis is supported in a supporting body located approximately halfway along the longitudinal extent of the stick such to have the applying spatula pivoting around said first pivot axis by means of the manually rotatable operating axis at each point of return of said stick moved manually back and forth over a floor, whereby said applying spatula attains the respective position of its toothed edge parallel to the floor by a pressing thereagainst by a pivoting around said second pivot axis.

2. The apparatus of claim 1, wherein said first and said second pivot axes intersect each other at an angle different from 90°.

3. The apparatus of claim 2, wherein said first and said second pivot axes intersect each other at an angle of about 65°.

4. The apparatus of claim 1, wherein said operating rod is pivotably mounted at its ends to said joint body and to said lever by means of a respective intermediate member which is mounted to said joint body and said lever, respectively, to rotate relatively thereto.

5. The apparatus of claim 1, wherein the supporting body for the applying spatula is a planar disk abutting the joint body mounted to the first pivot axis at a oblique sliding surface formed thereupon, to which planar disk the applying spatula is mounted exchangeably.

6. The apparatus of claim 5, wherein said applying spatula is mounted to said disk by hooks located at said disk which snap into recesses of said applying spatula.

* * * * *